US010627166B2

(12) United States Patent
Nakamura et al.

(10) Patent No.: US 10,627,166 B2
(45) Date of Patent: Apr. 21, 2020

(54) U-TUBE HEAT EXCHANGER

(71) Applicant: Mitsubishi Hitachi Power Systems, Ltd., Kanagawa (JP)

(72) Inventors: Taichi Nakamura, Yokohama (JP); Katsuhiro Hotta, Yokohama (JP); Satoshi Hiraoka, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 78 days.

(21) Appl. No.: 16/074,940

(22) PCT Filed: Sep. 30, 2016

(86) PCT No.: PCT/JP2016/079183
§ 371 (c)(1),
(2) Date: Aug. 2, 2018

(87) PCT Pub. No.: WO2017/138188
PCT Pub. Date: Aug. 17, 2017

(65) Prior Publication Data

US 2019/0033002 A1 Jan. 31, 2019

(30) Foreign Application Priority Data

Feb. 8, 2016 (JP) ..... 2016-021880

(51) Int. Cl.
*F28D 7/06* (2006.01)
*F28F 9/02* (2006.01)
(Continued)

(52) U.S. Cl.
CPC ..... *F28D 7/06* (2013.01); *F28D 7/12* (2013.01); *F28F 9/0209* (2013.01); *F28F 9/22* (2013.01);
(Continued)

(58) Field of Classification Search
CPC .. F28D 7/06; F28D 7/12; F28F 9/0209; F28F 9/22; F28F 2009/222; F28F 2009/224; F28F 2009/226
(Continued)

(56) References Cited

U.S. PATENT DOCUMENTS 5,544,700 A * 8/1996 Shagoury ..... F02C 7/14 165/139
2006/0076126 A1* 4/2006 Fandry ..... F28D 7/06 165/159
(Continued)

FOREIGN PATENT DOCUMENTS

JP 3-22560 3/1991
JP 06-323766 11/1994
(Continued)

OTHER PUBLICATIONS

International Search Report dated Dec. 13, 2016 in International (PCT) Application No. PCT/JP2016/079183.
(Continued)

*Primary Examiner* — Joel M Attey
(74) *Attorney, Agent, or Firm* — Wenderoth, Lind & Ponack, L.L.P.

(57) ABSTRACT

A U-tube heat exchanger wherein a tube support plate divides the interior of a tube-exterior fluid chamber into a curved-tube chamber on a second end side including curved-tube sections of the U-tubes, and a chamber on a first end side. A second partition wall divides the interior of the chamber on the first end side inside the tube-exterior fluid chamber into a first straight-tube chamber including inlet-side straight-tube sections of the U-tubes, and a second straight-tube chamber including outlet-side straight-tube sections of the U-tubes. An opening penetrating from the first straight-tube chamber into the second straight-tube chamber is formed in the second partition wall. First passage
(Continued)

holes, which penetrate from the first straight-tube chamber into the curved-tube chamber, and second passage holes, which penetrate from the second straight-tube chamber into the curved-tube chamber, are formed in the tube support plate.

7 Claims, 8 Drawing Sheets

(51) Int. Cl.
*F28F 9/22* (2006.01)
*F28D 7/12* (2006.01)

(52) U.S. Cl.
CPC ... *F28F 2009/222* (2013.01); *F28F 2009/224* (2013.01); *F28F 2009/226* (2013.01)

(58) Field of Classification Search
USPC ..... 165/161
See application file for complete search history.

(56) References Cited

U.S. PATENT DOCUMENTS

| | | | |
|---|---|---|---|
| 2009/0020273 | A1 | 1/2009 | Schneider et al. |
| 2016/0003551 | A1 | 1/2016 | Fujita et al. |

FOREIGN PATENT DOCUMENTS

| | | |
|---|---|---|
| JP | 2002-357394 | 12/2002 |
| KR | 10-2009-0009132 | 1/2009 |

OTHER PUBLICATIONS

Written Opinion of the International Searching Authority dated Dec. 13, 2016 in International (PCT) Application No. PCT/JP2016/079183.

* cited by examiner

U-TUBE HEAT EXCHANGER

TECHNICAL FIELD

The present invention relates to a U-tube heat exchanger.

This application claims priority based on JP 2016-021880 filed in Japan on Feb. 8, 2016, of which the contents are incorporated herein by reference.

BACKGROUND ART

U-tube heat exchangers, which is a heat exchanger provided with an outer cylinder, a tube plate that divides an inside of the outer cylinder into a first end side tube-interior fluid chamber and a second end side tube-exterior fluid chamber, and a plurality of U-tubes disposed inside the tube-exterior fluid chamber and having both ends thereof fixed to the tube plate.

One example of such a U-tube heat exchanger is disclosed in Patent Document 1, for example. The tube-exterior fluid chamber of this U-tube heat exchanger is provided with a partition wall that divides the tube-exterior fluid chamber into a first straight-tube chamber including inlet-side straight-tube sections of the U-tubes, and a second straight-tube chamber including outlet-side straight-tube sections of the U-tubes. Furthermore, the first straight-tube chamber and second straight-tube chamber are provided with a plurality of baffles. In this U-tube heat exchanger, a tube-exterior fluid is also caused to flow in a region where curved-tube sections of the U-tubes exist, or in other words, an end plate region on the inner side of an end plate of an outer cylinder, in order to increase the heat transfer area between a tube-interior fluid flowing inside the U-tubes and the tube-exterior fluid flowing outside the U-tubes.

CITATION LIST

Patent Document

Patent Document 1: JP 2002-357394 A

SUMMARY OF INVENTION

Technical Problem

In the aforementioned U-tube heat exchanger, the tube-exterior fluid also flows around the curved-tube sections of the U-tubes, and thus there is a possibility that the curved-tube sections will vibrate. In a case where the tube-exterior fluid is prevented from flowing to the region where the curved-tube sections exist inside the outer cylinder in order to suppress vibration of the curved-tube sections, the heat transfer area between the tube-exterior fluid and the tube-interior fluid will be smaller.

As a countermeasure, an object of the present invention is to provide a U-tube heat exchanger that can suppress vibration of the U-tubes while increasing the heat transfer area between the tube-exterior fluid and the tube-interior fluid.

Solution to Problem

In order to achieve the aforementioned object, a U-tube heat exchanger according to a first aspect of the present invention includes: an outer cylinder having a cylindrical shape and of which both ends are closed; a tube plate that divides an inside of the outer cylinder at a position on a first end side of the both ends into a tube-interior fluid chamber on the first end side and a tube-exterior fluid chamber on a second end side; a plurality of U-tubes disposed in the tube-exterior fluid chamber with both ends being fixed to the tube plate, the both ends of the plurality of U-tubes facing the tube-interior fluid chamber; a first partition wall that divides the tube-interior fluid chamber into an inlet chamber facing an inlet end group which is a collection of inlet ends of the both ends of the plurality of U-tubes and an outlet chamber facing an outlet end group which is a collection of outlet ends of the both ends of the plurality of U-tubes; a tube support plate that divides the tube-exterior fluid chamber into a curved-tube chamber including a curved-tube group which is a collection of curved-tube sections of the plurality of U-tubes on the second end side and a chamber on the first end side, the tube support plate supporting inlet-side straight-tube sections that extend from the inlet ends of the plurality of U-tubes and outlet-side straight-tube sections that extend from the outlet ends of the plurality of U-tubes; and a second partition wall that divides the chamber on the first end side relative to the curved-tube chamber of the tube-exterior fluid chamber into a first straight-tube chamber including an inlet-side straight-tube group which is a collection of the inlet-side straight-tube sections of the plurality of U-tubes and a second straight-tube chamber including an outlet-side straight-tube group which is a collection of the outlet-side straight-tube sections of the plurality of U-tubes, wherein, in the second end side of the second partition wall closer to the first end side than the tube support plate, an opening is formed that penetrates from the first straight-tube chamber toward the second straight-tube chamber, and the tube support plate includes at least one first passage hole formed penetrating from the first straight-tube chamber to the curved-tube chamber, and at least one second passage hole formed penetrating from the second straight-tube chamber to the curved-tube chamber.

In the U-tube heat exchanger, the tube-interior fluid flows into the inlet chamber of the tube-interior fluid chamber. The tube-interior fluid flows into the U-tubes from the inlet formed in the inlet end of the plurality of U-tubes. The tube-interior fluid that has flowed into the U-tubes flows out to the outlet chamber of the tube-exterior fluid chamber from the outlet formed in the outlet end of the U-tubes via the inlet-side straight-tube sections, curved sections, and outlet-side straight-tube sections of the U-tubes.

Furthermore, in the U-tube heat exchanger, the tube-exterior fluid flows into the second straight-tube chamber of the tube-exterior fluid chamber, for example. In the process of flowing through the inside of the second straight-tube chamber, the tube-exterior fluid that has flowed into the second straight-tube chamber exchanges heat with the tube-interior fluid flowing inside the outlet-side straight-tube sections of the plurality of U-tubes.

A portion of the tube-exterior fluid that has flowed into the second straight-tube chamber flows into the curved-tube chamber via the second passage holes of the tube support plate. In the process of flowing through the curved-tube chamber, the tube-exterior fluid exchanges heat with the tube-interior fluid flowing inside the curved-tube sections of the plurality of U-tubes. The tube-exterior fluid that has flowed into the curved-tube chamber flows into the first straight-tube chamber of the tube-exterior fluid chamber via the first passage holes in the tube support plate. Furthermore, another portion of the tube-exterior fluid that has flowed into the second straight-tube chamber flows into the first straight-tube chamber via the opening in the second partition wall.

In the process of flowing through the first straight-tube chamber, the tube-exterior fluid that has flowed into the first straight-tube chamber exchanges heat with the tube-interior fluid flowing inside the inlet-side straight-tube sections of the plurality of U-tubes.

As described above, in the U-tube heat exchanger, heat can be exchanged in the curved-tube chamber between the tube-exterior fluid and the tube-interior fluid that is inside the curved-tube sections of the U-tubes, thus making it possible to increase the heat transfer area more than in a U-tube heat exchanger that does not lead the tube-exterior fluid to the inside of the curved-tube chamber.

Among the directional components of the flow of the tube-exterior fluid in the curved-tube chamber including the curved-tube sections of the U-tube, a directional component along the curved-tube sections is dominant, but there is also a portion of a directional component intersecting the curved-tube sections. Therefore, when the tube-exterior fluid is flowing through the curved-tube chamber under constant conditions, the curved-tube sections of the curved-tube chamber vibrate.

As a countermeasure, in the U-tube heat exchanger, a portion of the tube-exterior fluid in the second straight-tube chamber is caused to flow into the curved-tube chamber, while the remaining portion is not allowed to flow into the curved-tube chamber, but rather is caused to flow into the first straight-tube chamber from the opening in the second partition wall, in order to suppress vibration of the curved-tube sections. As a result, the tube-exterior fluid flows through the curved-tube chamber in the U-tube heat exchanger, but the flow rate is slow, thus also slowing the flow rate of the direction component intersecting the curved-tube sections, which makes it possible to suppress vibration of the curved-tube sections.

The above description assumes that the tube-exterior fluid flows from the second straight-tube chamber to the first straight-tube chamber, but results similar to those described above are possible even in a case where the tube-exterior fluid flows from the first straight-tube chamber to the second straight-tube chamber.

In order to achieve the aforementioned object, a U-tube heat exchanger according to a second aspect of the present invention is the U-tube heat exchanger of the first aspect, wherein an opening area of the opening is wider than a total flow path cross sectional area of the at least one first passage hole and a total flow path cross sectional area of the at least one second passage hole.

In order to achieve the aforementioned object, a U-tube heat exchanger according to a third second aspect of the present invention is the U-tube heat exchanger of the first or the second aspect, wherein the tube support plate includes first tube holes in which respective inlet-side straight-tube sections of the plurality of U-tubes are inserted, and second tube holes in which respective outlet-side straight-tube sections of the plurality of U-tubes are inserted, the first passage holes are formed in positions between the plurality of first tube holes of the tube support plate, and the second passage holes are formed in positions between the plurality of second tube holes of the tube support plate.

In order to achieve the aforementioned object, a U-tube heat exchanger according to a fourth aspect of the present invention is the U-tube heat exchanger of the first or the second aspect, wherein the tube support plate includes first tube holes in which respective inlet-side straight-tube sections of the plurality of U-tubes are inserted, and second tube holes in which respective outlet-side straight-tube sections of the plurality of U-tubes are inserted, the first passage holes connect to any one of the plurality of first tube holes, and the second passage holes connect to any one of the plurality of second tube holes.

In order to achieve the aforementioned object, a U-tube heat exchanger according to a fifth aspect of the present invention is the U-tube heat exchanger of any one of the first to the fourth aspect, the U-tube heat exchanger further including a guide disposed in the curved-tube chamber, separated from the plurality of U-tubes, and having a curved surface that curves along the curved-tube section of a U-tube of any one of the plurality of U-tubes.

In the U-tube heat exchanger, the tube-exterior fluid of the curved-tube chamber can be made to flow along the curved-tube sections of the U-tubes; thus, it is possible to reduce the directional component intersecting the curved-tube sections of the directional components of the flow of the tube-exterior fluid. As a result, in the U-tube heat exchanger, it is possible to suppress vibration of the plurality of curved-tube sections more than a heat exchanger without the guide, even in a case where the amount of the tube-exterior fluid flowing into the curved-tube chamber is the same as the heat exchanger without the guide.

In other words, in the U-tube heat exchanger, it is possible to suppress vibration of the plurality of curved-tube sections even in a case where the amount of the tube-exterior fluid flowing into the curved-tube chamber is set to be greater than a heat exchanger without the guide. Accordingly, in the U-tube heat exchanger, it is possible to increase the amount of heat exchange in the curved-tube chamber between the tube-exterior fluid and the tube-interior fluid.

In order to achieve the aforementioned object, a U-tube heat exchanger according to a sixth aspect of the present invention is the U-tube heat exchanger of the fifth aspect, wherein a radius of curvature of the curved-tube section of a U-tube of any one of the plurality of U-tubes differs from a radius of curvature of the curved-tube sections of other U-tubes, and the guide includes at least one guide among: an inner guide that, relative to a smallest curved-tube section which is the curved-tube section with a smallest radius of curvature, is positioned on a radius of curvature side of the smallest curved-tube section, and has a convex curved surface that curves along the center of curvature side of the smallest curved-tube section; an outer guide that, relative to a largest curved-tube section which is the curved-tube section with a largest radius of curvature, is positioned on an opposite side of a radius of curvature side of the largest curved-tube section, and has a concave curved surface that curves along the opposite side of the largest curved-tube section; and a middle guide that is positioned between the smallest curved-tube section and the largest curved-tube section, and has a concave curved surface that curves along an opposite side of the radius of curvature side of the smallest curved-tube section and a convex curved surface that curves along the radius of curvature side of the largest curved-tube section.

In order to achieve the aforementioned object, a U-tube heat exchanger according to a seventh aspect of the present invention is the U-tube heat exchanger of any one of the first to the sixth aspect, the U-tube exchanger further including: at least one first baffle disposed in the first straight-tube chamber and widening in a direction intersecting a direction in which the inlet-side straight-tube sections extend; and at least one second baffle disposed in the second straight-tube chamber and widening in a direction intersecting a direction in which the outlet-side straight-tube sections extend, wherein the at least one first baffle includes at least one third passage hole penetrating in the direction in which the inlet-side straight-tube sections extend, and the at least one second baffle includes at least one fourth passage hole penetrating in the direction in which the inlet-side straight-tube sections extend.

In the U-tube heat exchanger, the first baffles are disposed in the first straight-tube chamber, and thus it is possible to increase the length of the flow path of the tube-exterior fluid flowing through the first straight-tube chamber. Moreover, in the U-tube heat exchanger, the second baffles are disposed in the second straight-tube chamber, and thus it is possible to increase the length of the flow path of the tube-exterior fluid flowing through the second straight-tube chamber. As a result, in the U-tube heat exchanger, it is possible to increase the amount of heat exchange between the tube-exterior fluid and the tube-interior fluid.

Furthermore, in the U-tube heat exchanger, there are baffles that extend in a direction intersecting the direction in which the straight-tube sections extend, but the baffles include passage holes penetrating the direction in which the straight-tube sections extend. Thus, it is possible to reduce the directional component intersecting the curved-tube sections of the directional components of the flow of the tube-exterior fluid. Accordingly, in the U-tube heat exchanger, it is possible to prevent vibration of the straight-tube sections.

Advantageous Effects of Invention

One aspect of the present invention makes it possible to suppress vibration of U-tubes while increasing the heat transfer area between a tube-exterior fluid and a tube-interior fluid.

DESCRIPTION OF EMBODIMENTS

Several embodiments of a U-tube heat exchanger of the present invention and modified examples of the embodiments will be described in detail below with reference to the drawings.

First Embodiment

A first embodiment of a U-tube heat exchanger according to the present invention will be described with reference to FIGS. 1 to 3.

Figure 1:
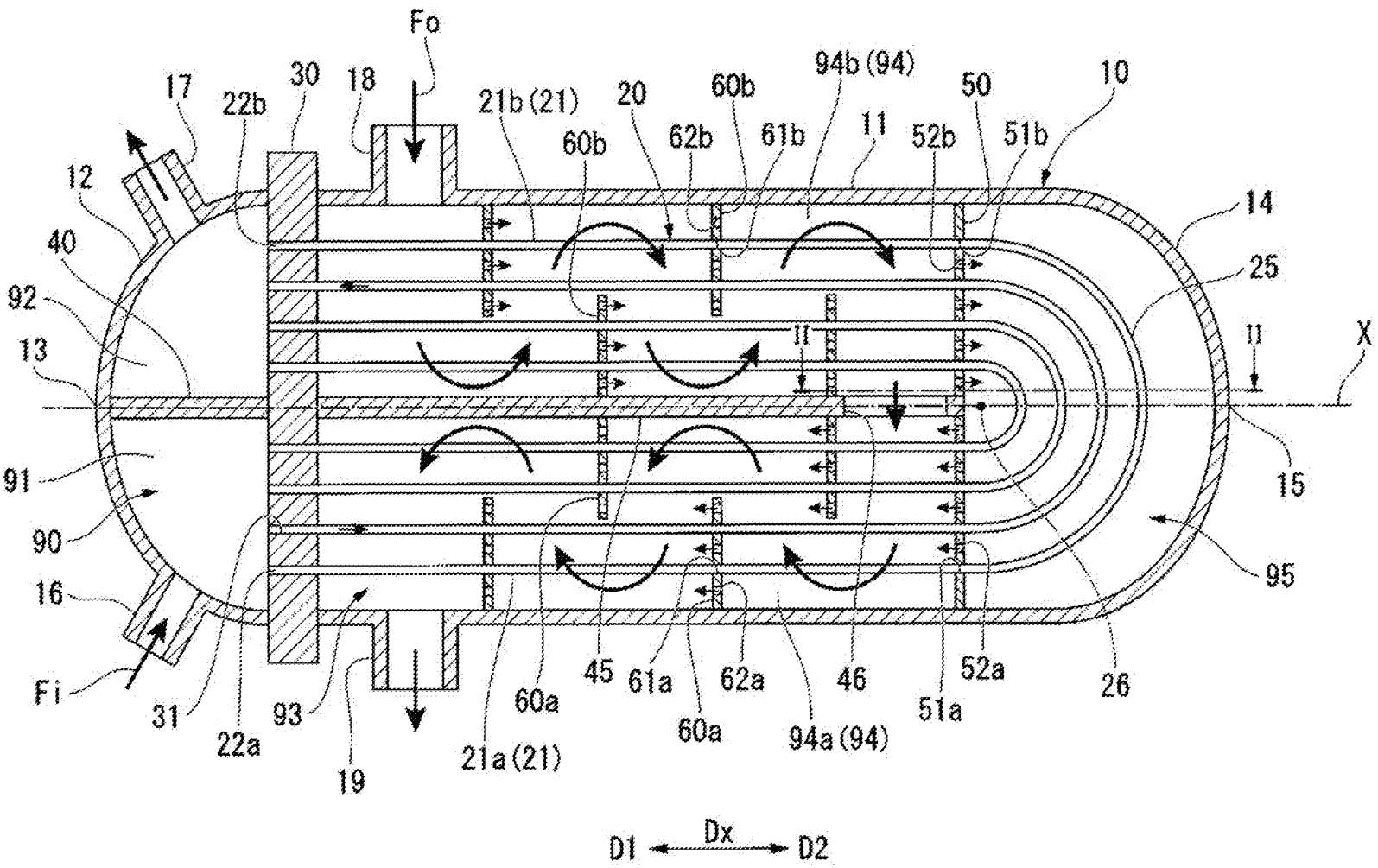
FIG. 1 is a cross-sectional view of a U-tube heat exchanger according to a first embodiment of the present invention.

As illustrated in FIG. 1, the U-tube heat exchanger of the present embodiment includes: a cylindrical outer cylinder 10; a tube plate 30 that divides the inside of the outer cylinder 10 into a tube-interior fluid chamber 90 and a tube-exterior fluid chamber 93; a plurality of U-tubes 20 disposed inside the tube-exterior fluid chamber 93; a first partition wall 40 that divides the inside of the tube-interior fluid chamber 90 into an inlet chamber 91 and an outlet chamber 92; a second partition wall 45 that divides the inside of the tube-exterior fluid chamber 93 into a first straight-tube chamber 94*a* and a second straight-tube chamber 94*b;* a plurality of first baffles 60*a* that change the flow direction of a tube-exterior fluid Fo flowing inside the first straight-tube chamber 94*a;* a plurality of second baffles 60*b* that change the flow direction of the tube-exterior fluid Fo flowing inside the second straight-tube chamber 94*b*; and a tube support plate 50 that supports the plurality of U-tubes 20.

The outer cylinder 10 has a cylindrical shape, and both ends thereof are closed. The outer cylinder 10 includes a trunk part 11 having a cylindrical shape centered about an axial line X, and a first end plate 12 and second end plate 14 connected to the ends of the trunk part 11. The direction in which the axial line X extends is denoted as the axial direction Dx. Furthermore, one side of the axial direction Dx is denoted as the first end side D1, and the other side is denoted as the second end side D2. The first end plate 12 is connected to the first end side D1 of the trunk part 11 and blocks the opening in the first end side D1 of the trunk part 11. The inner surface of the first end plate 12 gently recesses in a recessed shape toward a side further away from the second end plate 14, namely, toward the first end side D1. The second end plate 14 is connected to the second end side D2 end of the trunk part 11 and blocks the opening in the second end side D2 of the trunk part 11. The inner surface of the second end plate 14 gently recesses in a recessed shape toward a side further away from the first end plate 12, namely, toward the second end side D2. A portion of the first end plate 12 furthest on the first end side D1 is a first end 13 of the outer cylinder 10. Furthermore, a portion of the second end plate 14 furthest on the second end side D2 is a second end 15 of the outer cylinder 10.

The inside of the outer cylinder 10 is divided by the tube plate 30 at a position on the first end side D1 into a tube-interior fluid chamber 90 on the first end side D1 and a tube-exterior fluid chamber 93 on the second end side D2. More specifically, the inside of the outer cylinder 10 is divided at the boundary of the first end plate 12 and trunk part 11 by the tube plate 30 into the tube-interior fluid chamber 90 and the tube-exterior fluid chamber 93.

The U-tubes 20 each have a pair of straight-tube sections 21 and a curved-tube section 25 connecting ends of the pair of straight-tube sections 21 together. The curved-tube section 25 has a circular arc shape, with the position between the pair of straight-tube sections 21 as the center of curvature 26. Of the pair of straight-tube sections 21, one of the straight-tube sections 21 is an inlet-side straight-tube section 21*a*, and the other straight-tube section 21 is an outlet-side straight-tube section 21*b*. Of the both ends of the inlet-side straight-tube section 21*a*, the end on the side opposite to the curved-tube section 25 is an inlet end 22*a*. The inlet end 22*a* includes an inlet through which tube-interior fluid Fi flows into the U-tubes 20. Furthermore, of the both ends of the outlet-side straight-tube section 21*b*, the end on the side opposite to the curved-tube section 25 is an outlet end 22*b*. The outlet end 22*b* includes an outlet through which the tube-interior fluid Fi flows out from the U-tubes 20. Each of the straight-tube sections 21 of the U-tubes 20 extends in the axial direction Dx and has the same position in the axial direction Dx.

The plurality of U-tubes 20 are disposed inside the tube-exterior fluid chamber 93, and both ends 22*a*, 22*b* of the plurality of U-tubes 20 are fixed to the tube plate 30. The tube plate 30 has a substantially disc shape. The tube plate 30 includes tube holes 31 penetrating in the axial direction Dx and communicating with each inlet end 22*a* and each outlet end 22*b* of the plurality of U-tubes 20. The plurality of tube holes 31 in one half of the circle of the disc shaped tube plate 30 communicate with the inlet ends 22*a* of the plurality of U-tubes 20. The inlet ends 22*a* of the plurality of U-tubes 20 all face the tube-interior fluid chamber 90. The inlet ends 22*a* of the U-tubes 20 are fixed to the tube holes 31. Furthermore, the plurality of tube holes 31 in the other half of the circle of the disc shaped tube plate 30 communicate with the outlet ends 22*b* of the plurality of U-tubes 20. The outlet ends 22*b* of the plurality of U-tubes 20 all face the tube-interior fluid chamber 90. The outlet ends 22*b* of the U-tubes 20 are fixed to the tube holes 31. Each of the curved-tube sections 25 of the plurality of U-tubes 20 is disposed inside a curved-tube chamber 95, which combines a region of the tube-exterior fluid chamber 93 on the inner side of the second end plate 14 and a region of the tube-exterior fluid chamber 93 on the inner side of the trunk part 11 on the second end plate 14 side.

The first partition wall 40 divides the inside of the tube-interior fluid chamber 90 into an inlet chamber 91 facing an inlet end group which is a collection of the inlet ends 22*a* of the U-tubes 20, and an outlet chamber 92 facing an outlet end group which is a collection of the outlet ends 22*b* of the U-tubes 20. The first end plate 12 is provided with a tube-interior side inlet nozzle 16 that allows the inner side inlet chamber 91 to communicate with outside, and a tube-interior side outlet nozzle 17 that allows the inner side outlet chamber 92 to communicate with outside.

The tube support plate 50 is disposed inside the tube-exterior fluid chamber 93 and divides the inside of the tube-exterior fluid chamber 93 into the aforementioned curved-tube chamber 95 and a chamber other than the curved-tube chamber 95. In other words, the tube support plate 50 divides the inside of the tube-exterior fluid chamber 93 into a second end side D2 chamber and a first end side D1 chamber. The tube support plate 50 includes first tube holes 51*a* communicating with second end side D2 portions of the inlet-side straight-tube sections 21*a* of the plurality of U-tubes 20, and second tube holes 51*b* communicating with second end side D2 portions of the outlet-side straight-tube sections 21*b* of the plurality of U-tubes 20. The inlet-side straight-tube sections 21*a* of the plurality of U-tubes 20 communicate with the first tube holes 51*a* and are thereby supported by the tube support plate 50. Furthermore, the outlet-side straight-tube sections 21*b* of the plurality of U-tubes 20 communicate with the second tube holes 51*b* and are thereby supported by the tube support plate 50.

The second partition wall 45 is disposed inside the tube-exterior fluid chamber 93 and divides chambers in the tube-exterior fluid chamber 93 further on the first end side D1 than the curved-tube chamber 95 into a first straight-tube chamber 94*a* including an inlet-side straight-tube group which is a collection of the inlet-side tube sections 21*a* of the U-tubes 20, and a second straight-tube chamber 94*b* including an outlet-side straight-tube group which is a collection of outlet-side straight-tube sections 21*b* of the U-tubes 20. The second partition wall 45 extends from the tube plate 30 up to the tube support plate 50 in the axial direction Dx.

The trunk part 11 of the outer cylinder 10 is provided with a tube-exterior side inlet nozzle 18 that allows the inner side second straight-tube chamber 94*b* to communicate with outside, and a tube-exterior side outlet nozzle 19 that allows the inner side first straight-tube chamber 94*a* to communicate with outside.

The plurality of first baffles 60*a* that change the flow direction of the tube-exterior fluid Fo are disposed inside the first straight-tube chamber 94*a*. Furthermore, the plurality of second baffles 60*b* that change the flow direction of the tube-exterior fluid Fo are also disposed inside the second straight-tube chamber 94*b*. Each of the baffles 60*a*, 60*b* is provided along a virtual plane extending in an intersecting direction that intersects the axial direction Dx in which each of the straight-tube sections 21 of the U-tubes 20 extend, specifically, along a virtual plane extending in a direction perpendicular to the axial direction X. However, each of the baffles 60*a*, 60*b* is provided along only one region of the virtual plane inside the straight-tube chamber 94 and is not provided in the remaining regions. Accordingly, each of the baffles 60*a*, 60*b* divides the inside of the straight-tube chamber 94 into the first end side D1 and second end side D2 in one region of the virtual plane, but the baffles are not provided in the remaining regions of the virtual plane and do not divide the inside of the straight-tube chamber 94. The plurality of first baffles 60*a* are disposed inside the first straight-tube chamber 94*a* with mutually differing positions in the axial direction Dx. Furthermore, the plurality of second baffles 60*b* are disposed inside the second straight-tube chamber 94*b* with mutually differing positions in the axial direction Dx. Among the plurality of first baffles 60*a*, two of the first baffles 60*a* adjacent in the axial direction Dx mutually differ in the regions thereof dividing the inside of the straight-tube chamber 94 into the first end side D1 and the second end side D2. Furthermore, among the plurality of second baffles 60*b*, two of the second baffles 60*b* adjacent in the axial direction Dx mutually differ in the regions thereof dividing the inside of the straight-tube chamber 94 into the first end side D1 and the second end side D2. The first baffles 60*a* includes first tube holes 61*a* communicating with the inlet-side straight-tube sections 21*a* of the U-tubes 20. Furthermore, the second baffles 60*b* includes second tube holes 61*b* communicating with the outlet-side straight-tube sections 21*b* of the U-tubes 20.

Figure 2:
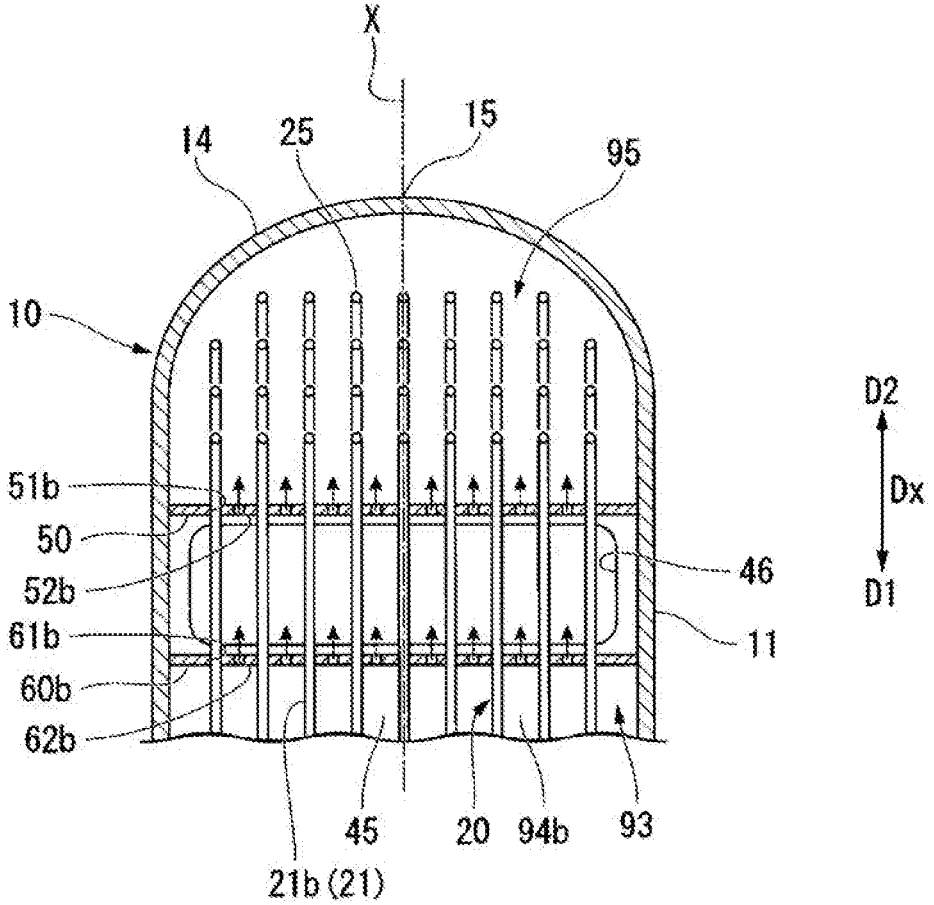
FIG. 2 is a cross-sectional view taken along the line II-II of FIG. 1.

As illustrated in FIG. 1 and FIG. 2, an opening 46 penetrating from the first straight-tube chamber 94*a* to the second straight-tube chamber 94*b* is formed in the second end side D2 of the second partition wall 45 further on the first end side D1 than the tube support plate 50. Moreover, the tube support plate 50 includes first passages holes 52*a* formed in positions between the plurality of first tube holes 51*a* and penetrate from the first straight-tube chamber 94*a* to the curved-tube chamber 95, and second passage holes 52*b* formed in positions between the plurality of second tube holes 51*b* and penetrate from the second straight-tube chamber 94*b* to the curved-tube chamber 95. The first baffles 60*a* include a plurality of third passage holes 62*a* formed in positions between respective first tube holes 61*a* and penetrating in the axial direction Dx. The second baffles 60*b* include a plurality of fourth passage holes 62*b* formed in positions between respective second tube holes 61*b* and penetrating in the axial direction Dx.

Figure 3:
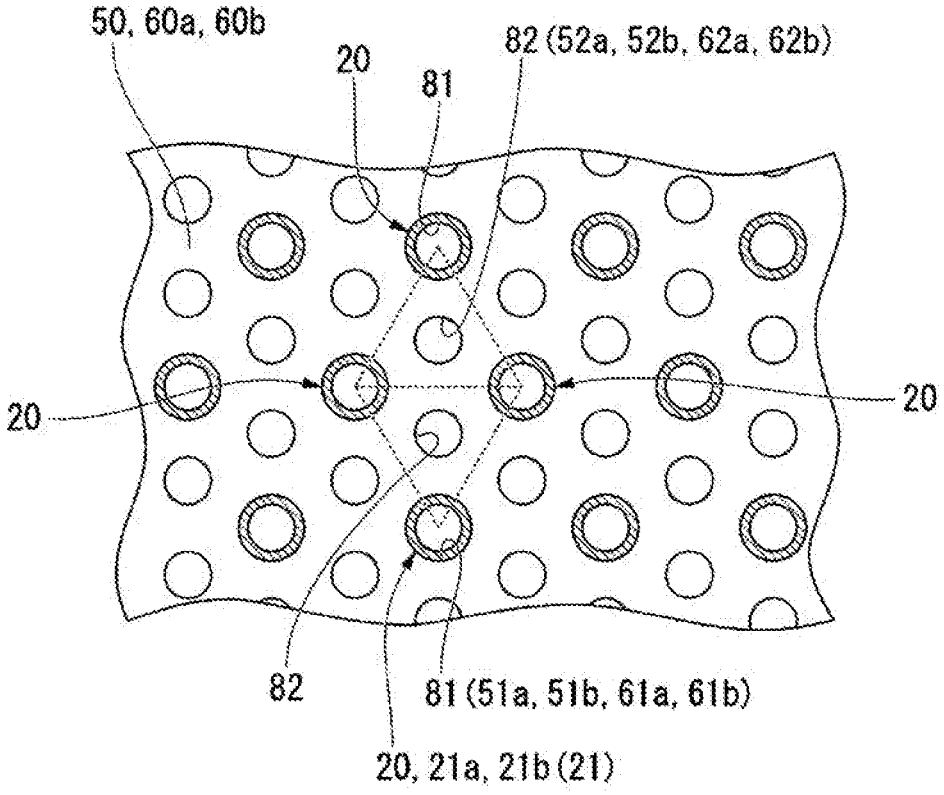
FIG. 3 is an explanatory view illustrating a positional relationship between tube holes and passage holes according to the first embodiment of the present invention.

The tubes are arranged in an equilateral triangle shape in the present embodiment, as illustrated in FIG. 3. In other words, each of the straight-tube sections 21 of the plurality of U-tubes 20 in the present embodiment is disposed in a position at the vertex of an equilateral triangle. Herein, the first tube holes 51*a* of the tube support plate 50, the second tube holes 51*b* of the tube support plate 50, the first tube holes 61*a* of the first baffles 60*a*, and the second tube holes 61*b* of the second baffles 60*b* will simply be denoted as tube holes 81. Furthermore, the first passage holes 52*a* formed between the plurality of first tube holes 51*a* of the tube support plate 50, the second passage holes 52*b* formed between the plurality of second tube holes 51*b* of the support plate 50, the third passage holes 62*a* formed between the plurality of first tube holes 61*a* of the first baffles 60*a*, and the fourth passage holes 62*b* formed between the plurality of second tube holes 61*b* of the second baffles 60*b* will simply be denoted as passage holes 82. The passage holes 82 are formed in the center of the aforementioned equilateral triangle.

The total flow path cross sectional area of the plurality of first passage holes 52*a* formed in the tube support plate 50 is substantially the same as the total flow path cross sectional area of the plurality of second passage holes 52*b* formed in the tube support plate 50. The area of the opening 46 formed in the second partition wall 45 is greater than the total flow path cross sectional area of the plurality of first passage holes 52*a* and the total flow path cross sectional area of the plurality of second passage holes 52*b*.

The tube-interior fluid Fi flows into the inlet chamber 91 of the tube-interior fluid chamber 90 from the tube-interior side inlet nozzle 16. The tube-interior fluid Fi that has flowed into the inlet chamber 91 flows into the U-tubes 20 from the inlet of the plurality of U-tubes 20. The tube-interior fluid Fi that has flowed into the U-tubes 20 flows out to the outlet chamber 92 of the tube-interior fluid chamber 90 from the U-tubes 20 via the inlet-side straight-tube sections 21*a*, curved sections 25, and outlet-side straight-tube sections 21*b* of the U-tubes 20. The tube-interior fluid Fi that has reached the outlet chamber 92 flows outside from the tube-interior side outlet nozzle 17.

The tube-exterior fluid Fo flows into the second straight-tube chamber 94*b* of the tube-exterior fluid chamber 93 from the tube-exterior side inlet nozzle 18. The tube-exterior fluid Fo that has flowed into the second straight-tube chamber 94*b* flows through this second straight-tube chamber 94*b*. At this time, the tube-exterior fluid Fo flows along a zigzagging flow path formed by the inner surface of the trunk part 11 of the outer cylinder 10, the second partition wall 45, and the plurality of second baffles 60*b*. In other words, the tube-exterior fluid Fo flows toward the second end side D2 while zigzagging through the second straight-tube chamber 94*b*. Furthermore, a portion of the tube-exterior fluid Fo that has flowed into the second straight-tube chamber 94*b* also flows toward the second end side D2 inside the plurality of fourth passage holes 62*b* of respective second baffles 60*b*. In the process of flowing through the second straight-tube chamber 94*b* as described above, the tube-exterior fluid Fo exchanges heat with the tube-interior fluid Fi flowing inside the outlet-side straight-tube section 21*b* of the plurality of U-tubes 20.

A portion of the tube-exterior fluid Fo that has flowed into the second straight-tube chamber 94*b* flows into the curved-tube chamber 95 via the second passage holes 52*b* of the tube support plate 50. In the process of flowing through the curved-tube chamber 95, the tube-exterior fluid Fo exchanges heat with the tube-interior fluid Fi flowing inside the curved-tube sections 25 of the plurality of U-tubes 20.

The tube-exterior fluid Fo that has flowed into the curved-tube chamber 95 flows into the first straight-tube chamber 94*a* of the tube-exterior fluid chamber 93 via the first passage holes 52*a* of the tube support plate 50. Another portion of the tube-exterior fluid Fo that has flowed into the second straight-tube chamber 94*b* flows into the first straight-tube chamber 94*a* via the opening 46 of the second partition wall 45.

The tube-exterior fluid Fo that has flowed into the first straight-tube chamber 94*a* flows through this first straight-tube chamber 94*a*. At this time, the tube-exterior fluid Fo flows along a zigzagging flow path formed by the inner surface of the trunk part 11 of the outer cylinder 10, the second partition wall 45, and the plurality of first baffles 60*a*. In other words, the tube-exterior fluid Fo flows toward the first end side D1 while zigzagging through the first straight-tube chamber 94*a*. Furthermore, a portion of the tube-exterior fluid Fo that has flowed into the first straight-tube chamber 94*a* also flows toward the first end side D1 through the inside of the plurality of third passage holes 62*a* of respective first baffles 60*a*. In the process of flowing through the first straight-tube chamber 94*a* as described above, the tube-exterior fluid Fo exchanges heat with the tube-interior fluid Fi flowing inside the outlet-side straight-tube section 21*a* of the plurality of U-tubes 20.

The tube-exterior fluid Fo that has exchanged heat with the tube-interior fluid Fi flowing inside the inlet-side straight-tube section 21*a* of the plurality of U-tubes 20 flows outside from the tube-exterior side outlet nozzle 19.

As described above, in the U-tube heat exchanger of the present embodiment, heat can be exchanged in the curved-tube chamber 95 between the tube-exterior fluid Fo and the tube-interior fluid Fi that is inside the curved-tube section 25 of the U-tubes 20, thus making it possible to increase the heat transfer area more than a U-tube heat exchanger that does not lead the tube-exterior fluid Fo to the curved-tube chamber 95.

In the present embodiment, in contrast to the straight-tube sections 21, the curved-tube sections 25 of the U-tubes 20 are not supported by baffles etc. Moreover, among the directional components of the flow of the tube-exterior fluid Fo in the curved-tube chamber 95 including the curved-tube sections 25, there is a large number of directional components intersecting the curved-tube sections 25. Therefore, when the tube-exterior fluid Fo flows in the curved-tube chamber 95 under constant conditions, the curved-tube sections 25 inside the curved-tube chamber 95 vibrate.

As a countermeasure, in the present embodiment, a portion of the tube-exterior fluid Fo inside the second straight-tube chamber 94*b* is caused to flow into the curved-tube chamber 95, while the remaining portion is not allowed to flow into the curved-tube chamber 95, but rather is caused to flow into the first straight-tube chamber 94*a* from the opening 46 in the second partition wall 45, in order to suppress vibration of the curved-tube sections 25. As a result, as described above, the tube-exterior fluid Fo flows through the curved-tube chamber 95 in the present embodiment, but the flow rate is slow, thus making it possible to suppression vibration of the curved-tube sections 25.

In the present embodiment, there is a reduction in the amount of tube-exterior fluid Fo flowing into the curved-tube chamber 95 and a slowing of the flow rate of the tube-exterior fluid Fo flowing through the curved-tube chamber 95; thus, the total flow path cross sectional area of the plurality of first passage holes 52*a* in the tube support plate 50 and the total flow path cross sectional area of the plurality of second passage holes 52*b* in the tube support plate 50 are made smaller than the opening area of the opening 46 in the second partition wall 45.

However, in order to increase the amount of heat exchanged between the tube-exterior fluid Fo and the tube-interior fluid Fi inside the curved-tube chamber 95, it is preferable to have a large amount of the tube-exterior fluid Fo flowing into the curved-tube chamber 95. Accordingly, it is preferable that the total flow path cross sectional area of the plurality of first passage holes 52*a* and the total flow path cross sectional area of the second passage holes 52*b* be increased within a range whereby it is possible to suppress vibration of the curved-tube sections 25. Therefore, it is also possible that the total flow path cross sectional area of the plurality of first passage holes 52*a* and the total flow path cross sectional area of the plurality of second passage holes 52*b* could be made larger than the opening area of the opening 46 formed in the second partition wall 45, depending on the various dimensions of the members constituting the U-tube heat exchanger, the amount of the tube-exterior fluid Fo flowing into the tube-exterior flow chamber 93, the density of the tube-exterior fluid Fo, the amount of tube-interior fluid Fi flowing into the plurality of U-tubes 20, the density of the tube-interior fluid Fi, and the like.

The plurality of first baffles 60*a* are disposed inside the first straight-tube chamber 94*a* in the present embodiment. Furthermore, the plurality of second baffles 60*b* are disposed inside the second straight-tube chamber 94*b*. When the baffles 60*a*, 60*b* are disposed in this manner inside the straight-tube chamber 94, the tube-exterior fluid Fo flows in a direction intersecting the straight-tube sections 21 of the U-tubes 20 in a portion inside the straight-tube chamber 94. This results in good heat exchange efficiency, but also the possibility of causing the straight-tube sections 21 inside the straight-tube chamber 94 to vibrate. Each of the baffles 60*a*, 60*b* in the present embodiment includes the plurality of passage holes 62*a*, 62*b* that penetrate in the axial direction Dx in which the straight-tube sections 21 extend, and thus it is possible to reduce the directional component intersecting the axial direction Dx in which the straight-tube sections 21 extend among the directional components of the flow of the tube-exterior fluid Fo inside the straight-tube chamber 94. Thus, in the present embodiment, although there are a plurality of baffles 60*a*, 60*b* disposed inside the straight-tube chamber 94, it is possible to suppress vibration of the straight-tube sections 21 inside the straight-tube chamber 94 and to improve the efficiency of heat exchange.

Second Embodiment

Figure 4:
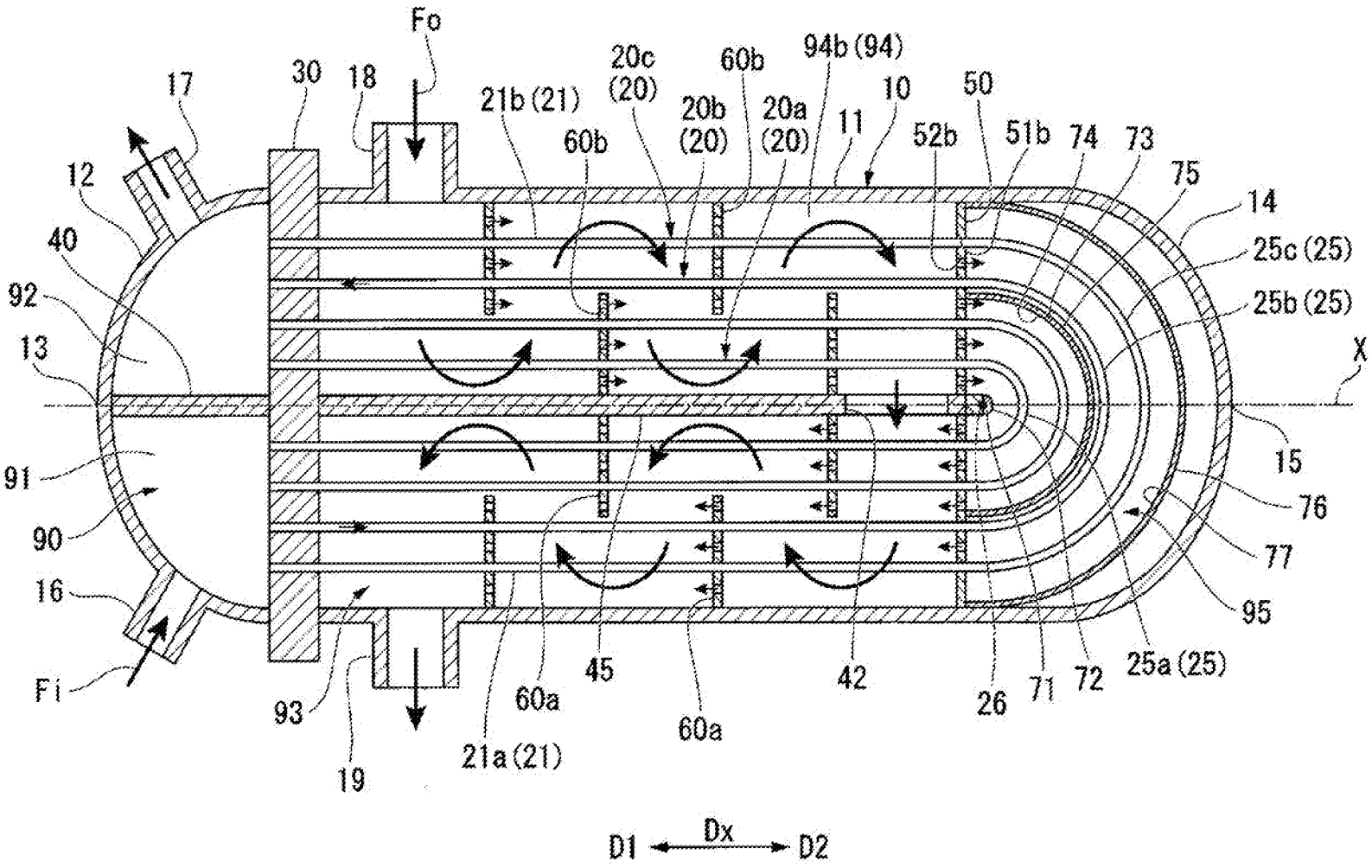
FIG. 4 is a cross-sectional view of a U-tube heat exchanger according to a second embodiment of the present invention.

The following describes a second embodiment of the U-tube heat exchanger of the present invention with reference to FIG. 4.

The U-tube heat exchanger of the present embodiment includes an inner guide 71, a middle guide 73, and an outer guide 76 added to the U-tube heat exchanger of the first embodiment. The inner guide 71, middle guide 73, and outer guide 76 are all disposed inside the curved-tube chamber 95.

The radius of curvature of each of the curved-tube sections 25 of the plurality of U-tubes 20 differs from the radius of curvature of other curved-tube sections 25. Thus, the plurality of U-tubes 20 includes a U-tube 20*a* including a smallest curved-tube section 25*a* which is the curved-tube section 25 having a smallest radius of curvature, a U-tube 20*c* including a largest curved-tube section 25*c* which is the curved-tube section 25 having a largest radius of curvature, and U-tubes 20*b* including an intermediate curved-tube section 25*b* which is the curved-tube section 25 having an intermediate radius of curvature. The center of curvatures 26 of the curved-tube sections 25 of the plurality of U-tubes 20 are all substantially on the axial line X and positioned on the first end side D1 inside the curved-tube chamber 95. Therefore, the intermediate curved-tube sections 25*b* are positioned closer to the center of curvature 26 side than the largest curved-tube section 25*c*, and the smallest curved-tube section 25*a* is positioned closer to the center of curvature 26 side than the intermediate curved-tubes 25*b*. In the present embodiment, the plurality of intermediate curved-tube sections 25*b* also have differing radii of curvature from one another.

The inner guide 71 is disposed in a position separated from the smallest curved-tube section 25*a* on the radius of curvature 26 side of the smallest curved-tube section 25*a*. The inner guide 71 has a convex curved surface 72 that curves along the radius of curvature 26 side of the smallest curved-tube section 25*a*. The inner guide 71 is fixed to the tube support plate 50, for example.

The outer guide 76 is disposed in a position separated from the largest curved-tube section 25*c* on the side opposite to the radius of curvature 26 side of the largest curved-tube section 25*c*. The outer guide 76 has a concave curved surface 77 that curves along the side opposite to the radius of curvature 26 side of the largest curved-tube section 25*c*. The outer guide 76 is fixed to the inner surface of the outer cylinder 10 or the tube support plate 50, for example.

The middle guide 73 is disposed between the plurality of intermediate curved-tube sections 25*b* in a position separated from each of the intermediate curved-tube sections 25*b*. The middle guide 73 has a concave curved surface 74 and a convex curved surface 75. The concave curved surface 74 of the middle guide 73 bends in reference to the middle guide 73 along the side opposite to the center of curvature 26 side of the curved-tube sections 25 positioned on the radius of curvature 26 side. The convex curved surface 75 of the middle guide 73 has a convex curved surface 75 that curves in reference to the middle guide 73 along the center of curvature 26 side of the curved-tube sections 25 positioned on the side opposite to the radius of curvature 26 side.

As described above, in the present embodiment, the inner guide 71, middle guide 73, and outer guide 76 are disposed in the curved-tube chamber 95, and thus the tube-exterior fluid Fo in the curved-tube chamber 95 flow along the curving of the curved-tube sections 25 on the center of curvature 26 side of the curved-tube chamber 95, the side opposite thereto, and also the position therebetween. In other words, in the present embodiment, it is possible to reduce the directional component intersecting the curved-tube sections 25 among the directional components of the flow of the tube-exterior fluid Fo in the curved-tube chamber 95.

As a result, in the present embodiment, it is possible to further suppress vibration of the plurality of curved-tube sections 25 in the curved-tube chamber 95 than in the first embodiment, even in a case where the amount of the tube-exterior fluid Fo flowing into the curved-tube chamber 95 is the same as the first embodiment.

In other words, in the present embodiment, it is possible to suppress vibration of the plurality of curved-tube sections 25 in the curved-tube chamber 95 even in a case where the amount of the tube-exterior fluid Fo flowing into the curved-tube chamber 95 is set to be greater than in the first embodiment. Accordingly, in the present embodiment, it is possible to increase the amount of heat exchange in the curved-tube chamber 95 between the tube-exterior fluid Fo and the tube-interior fluid Fi.

In the present embodiment, the inner guide 71, middle guide 73, and outer guide 76 are disposed inside the curved-tube chamber 95. However, it is also possible for only any one or two among the inner guide 71, middle guide 73, and outer guide 76 to be disposed inside the curved-tube chamber 95.

Third Embodiment

Figure 5:
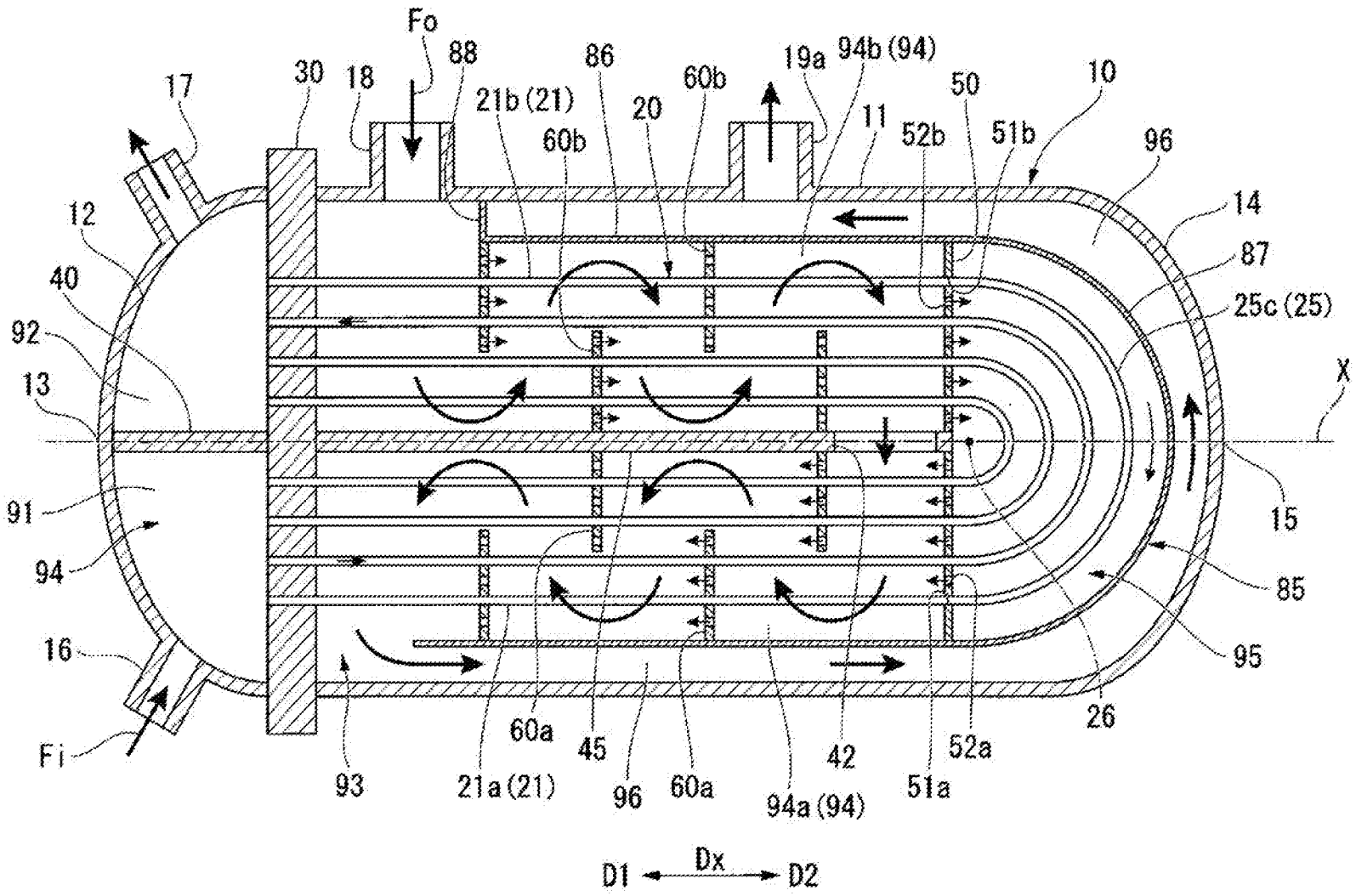
FIG. 5 is a cross-sectional view of a U-tube heat exchanger according to a third embodiment of the present invention.

The following describes a third embodiment of the U-tube heat exchanger of the present invention with reference to FIG. 5.

The U-tube heat exchanger of the present embodiment has an inner cylinder 85 added to the U-tube heat exchanger of the first embodiment. The inner cylinder 85 is disposed inside the outer cylinder 10.

The inner cylinder 85 includes a trunk part 86 having a cylindrical shape centered about the axial line X, an end plate 87 connected to the trunk part 86 on the second end side D2, and a partition plate 88 connected to the trunk part 86 on the first end side D1. The cylindrical trunk part 86 is separated from the inner surface of the trunk part 11 of the outer cylinder 10 toward the side closer to the axial line X. In other words, the outer diameter of the trunk part 86 of the inner cylinder 85 is smaller than the inner diameter of the trunk part 11 of the outer cylinder 10. The end plate 87 closes an opening in the second end side D2 end of the trunk part 86. The inner surface of the end plate 87 gently recesses in a recessed shape toward the second end side D2, and the outer surface gently protrudes in a protruding shape toward the second end side D2. In particular, the inner surface of the end plate 87 gently curves along the largest curved-tube part 25*c*. Meanwhile, the first end side D1 end of the trunk part 86 is not provided with an end plate or the like. Due to this, the first end side D1 end of the inner cylinder 85 is open. The outer surface of the end plate 87 is separated from the inner surface of the second end plate 14 of the outer cylinder 10 toward the inner side of the second end plate 14. The trunk part 86 is disposed inside the tube-exterior fluid chamber 93 such that the position of the first end side D1 end in the axial direction Dx is positioned closer to the second end side D2 than the tube-exterior side inlet nozzle 18. The partition plate 88 is provided on the first end side D1 end of the trunk part 86 in a portion inside the second straight-tube chamber 94*b* and extends outwards in a radial direction relative to the axial line X. The edge of the partition plate 88 outwards in the radial direction is connected to the inner surface of the outer cylinder 10. Accordingly, the tube-exterior fluid Fo that has flowed into the second straight-tube chamber 94*b* from the tube-exterior side inlet nozzle 18 does not directly flow into a gap between the outer cylinder 10 and the inner cylinder 85. Meanwhile, the partition plate extending outwards in the radial direction relative to the axial line X is not provided on the first end side D1 end of the trunk part 86 in a portion inside the first straight-tube chamber 94*a*. Accordingly, the tube-exterior fluid Fo that has exchanged heat with the tube-interior fluid Fi that is inside the inlet-side straight-tube sections 21*a* of the U-tubes 20 inside the first straight-tube chamber 94*a* flows into a cylinder-interior outlet flow path 96 between the inner surface of the outer cylinder 10 and outer surface of the inner cylinder 85 from the gap between the inner surface of the outer cylinder 10 and the first end side D1 end of the trunk part 86 of the inner cylinder 85.

A tube-exterior side outlet nozzle 19*a* of the present embodiment differs from the first embodiment in being connected to the trunk part 11 of the outer cylinder 10 at a portion outside the second straight-tube chamber 94*b*, in a similar manner to the tube-exterior side inlet nozzle 18. The tube-exterior side outlet nozzle 19*a* allows the cylinder-interior outlet flow path 96 to communicate with outside.

The plurality of first baffles 60*a*, plurality of second baffles 60*b*, and tube support plate 50 in the present embodiment are all disposed inside the inner cylinder 85.

In the present embodiment also, the tube-exterior fluid Fo flows into the second straight-tube chamber 94*b* from the tube-exterior side inlet nozzle 18. In the process of flowing through the second straight-tube chamber 94*b* inside the inner cylinder 85, the tube-exterior fluid Fo exchanges heat with the tube-interior fluid Fi that is inside the outlet-side straight-tube section 21*b* of the U-tubes 20. A portion of the tube-exterior fluid Fo that has flowed into the second straight-tube chamber 94*b* flows into the curved-tube chamber 95 inside the inner cylinder 85 via the second passage holes 52*b* of the tube support plate 50. In the process of flowing through the curved-tube chamber 95, the tube-exterior fluid Fo exchanges heat with the tube-interior fluid Fi flowing inside the curved-tube sections 25 of the plurality of U-tubes 20. The tube-exterior fluid Fo that has flowed into the curved-tube chamber 95 flows into the first straight-tube chamber 94*a* inside the inner cylinder 85 via the first passage holes 52*a* in the tube support plate 50.

Another portion of the tube-exterior fluid Fo that has flowed into the second straight-tube chamber 94*b* flows into the first straight-tube chamber 94*a* inside the inner cylinder 85 via the opening 46 in the second partition wall 45. In the process of flowing through the first straight-tube chamber 94*a* inside the inner cylinder 85, the tube-exterior fluid Fo that has flowed into the first straight-tube chamber 94*a* exchanges heat with the tube-interior fluid Fi flowing inside the inlet-side straight-tube sections 21*a* of the plurality of U-tubes 20. As described above, the tube-exterior fluid Fo that has exchanged heat with the tube-interior fluid Fi that is inside the inlet-side straight-tube sections 21*a* of the U-tubes 20 in the first straight-tube chamber 94*a* flows into the cylinder-interior outlet flow path 96 between the inner surface of the outer cylinder 10 and outer surface of the inner cylinder 85. The tube-exterior fluid Fo that has flowed into the cylinder-interior outlet flow path 96 flows outside from the tube-exterior side outlet nozzle 19*a*.

In the present embodiment, the inner cylinder 85 is disposed inside the outer cylinder 10, and the tube-exterior side outlet nozzle 19*a* is connected to the trunk part 11 of the outer cylinder 10 at a portion outside the second straight-tube chamber 94*b*, in a similar manner to the tube-exterior side inlet nozzle 18. Due to this, the fluid in contact with the inner surface of the outer cylinder 10 almost entirely is the tube-exterior fluid Fo that has exchanged heat with the tube-interior fluid Fi that is inside the plurality of U-tubes 20 both on the first straight-tube chamber 94*a* side and the second straight-tube chamber 94*b* side. Accordingly, it is possible to decrease the difference in temperature between the temperature on the first straight-tube chamber 94*a* side of the outer cylinder 10 and the temperature on the second straight-tube chamber 94*b* side of the outer cylinder 10.

In a case where there is a large difference in temperature between the temperature of the tube-exterior fluid Fo flowing into the U-tube heat exchanger and the temperature of the tube-exterior fluid Fo that has exchanged heat inside the U-tube heat exchanger, in a heat exchanger in which the inner cylinder 85 is not present, such as in the first embodiment, there is a large difference in temperature between the temperature on the first straight-tube chamber 94*a* side of the outer cylinder 10 and the temperature on the second straight-tuber chamber 94*b* side of the outer cylinder 10. Thus, the expansion difference between the thermal expansion amount on the first straight-tube chamber 94*a* side of the outer cylinder 10 and the thermal expansion amount on the second straight-tube chamber 94*b* side would cause an increase in an amount of bending deformation of the outer cylinder 10.

As described above, in the present embodiment, the inner cylinder 85 being disposed inside the outer cylinder 10 makes it possible to decrease the difference in temperature between the temperature on the first straight-tube chamber 94*a* side of the outer cylinder 10 and the temperature on the second straight-tube chamber 94*b* side of the outer cylinder 10, thus making it possible to suppress bending deformations of the outer cylinder 10.

Furthermore, as described above, the inner surface of the end plate 87 of the inner cylinder 85 in the present embodiment gently curves along the largest curved-tube part 25*c*. Due to this, the end plate 87 of the inner cylinder 85 functions as the outside guide 76 of the second embodiment. Accordingly, in the present embodiment, in a similar manner to the second embodiment, it is possible to suppress vibration of the plurality of curved-tube sections 25 in the curved-tube chamber 95 even in a case where the amount of the tube-exterior fluid Fo flowing into the curved-tube chamber 95 is greater than in the first embodiment.

In the present embodiment, it is also possible to provide the inner guide 71, middle guide 73, or the like, as in the second embodiment.

Modified Examples of Passage Holes

Figure 6:
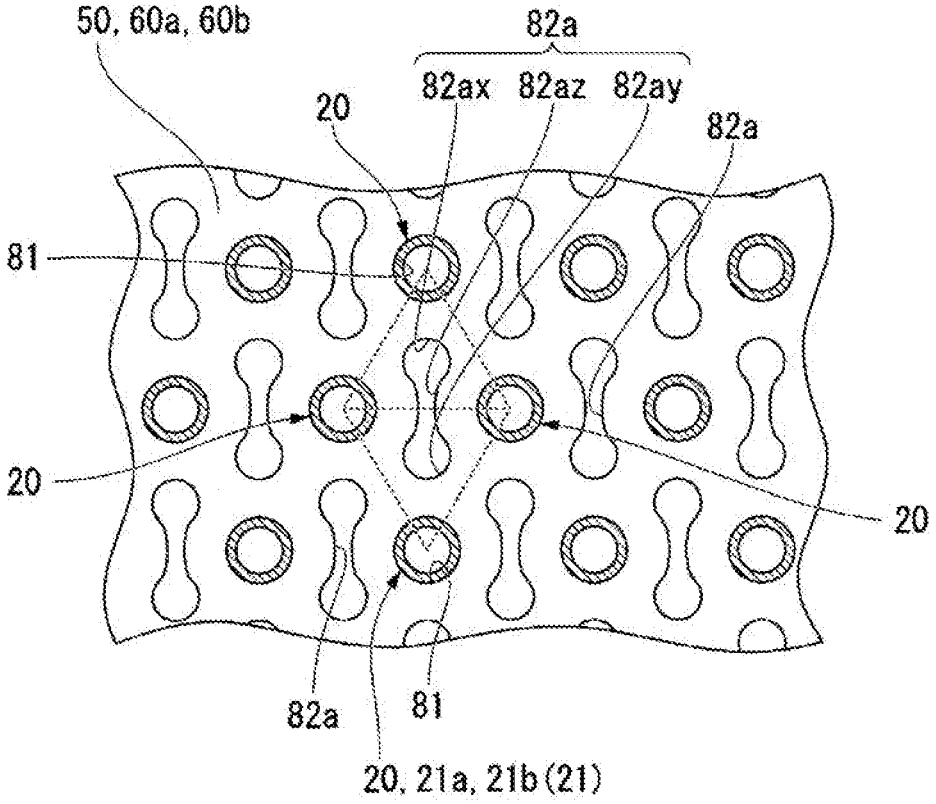
FIG. 6 is an explanatory view illustrating a positional relationship between tube holes and passage holes in a first modified example of the present invention.
Figure 7:
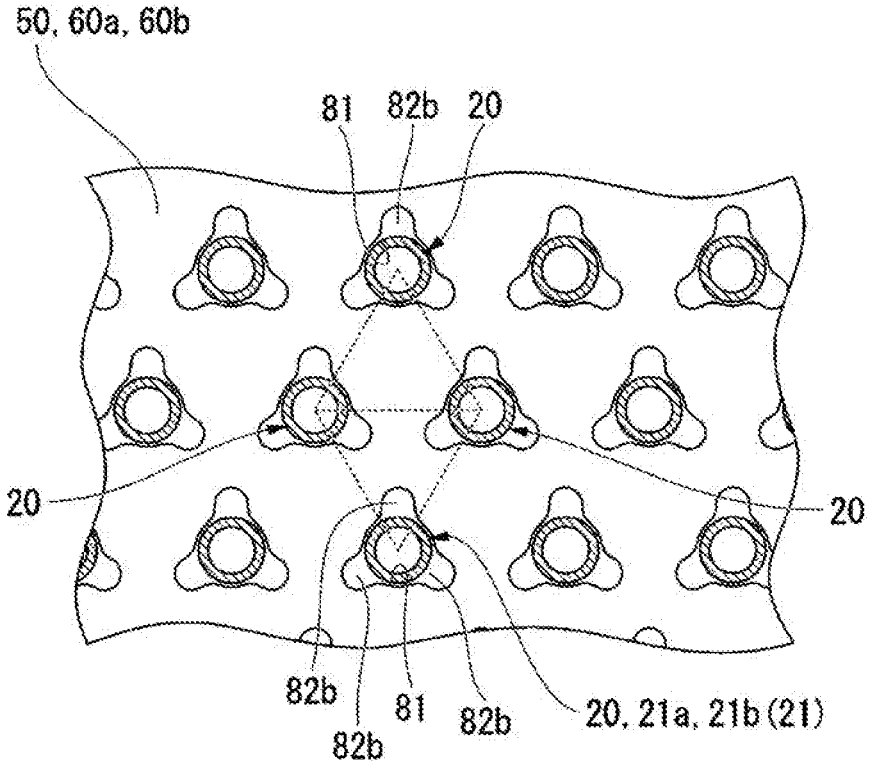
FIG. 7 is an explanatory view illustrating a positional relationship between tube holes and passage holes in a second modified example of the present invention.
Figure 8:
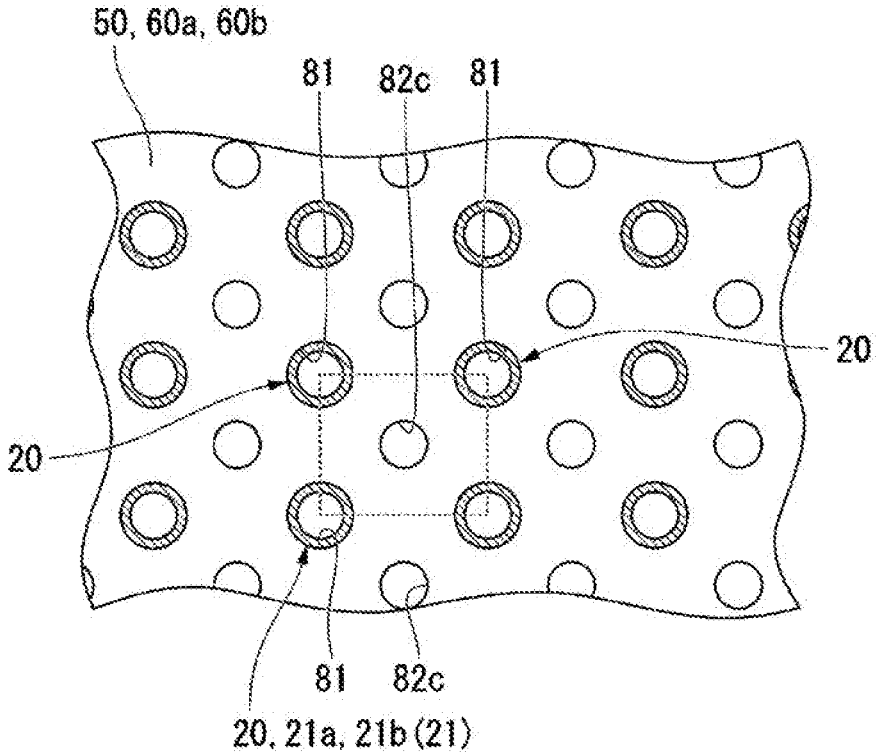
FIG. 8 is an explanatory view illustrating a positional relationship between tube holes and passage holes in a third modified example of the present invention.

Modified examples of the passage holes formed in the tube support plate 50, the first baffles 60*a*, and second baffles 60*b* will be described with reference to FIGS. 6 to 8. Hereinafter, the first tube holes 51*a* and the second tube holes 51*b* of the tube support plate 50, the first tube holes 61*a* of the first baffles 60*a*, and the second tube holes 61*b* of the second baffles 60*b* will simply be denoted as tube holes 81. Furthermore, the first passage holes 52*a* and the second passage holes 52*b* of the tube support plate 50, the third passage holes 62*a* of the first baffles 60*a*, and the fourth passage holes 62*b* of the second baffles 60*b* will simply be denoted as passage holes.

First, a first modified example of the passage holes will be described with reference to FIG. 6.

The tubes are also arranged in an equilateral triangular shape in the present modified example, in a similar manner to the first embodiment. In other words, each of the inlet-side straight-tube sections 21*a* of the plurality of U-tubes 20 in the present modified example is disposed in a position at the vertex of an equilateral triangle. Moreover, each of the outlet-side straight-tube sections 21*b* of the plurality of U-tubes 20 is also disposed in a position at the vertex of an equilateral triangle. In other words, the plurality of tube holes 81 are all disposed in positions at the vertices of equilateral triangles.

The passage holes 82*a* of the present modified example are also formed between the plurality of tube holes 81, in a similar manner to the first embodiment. However, the passage hole 82*a* of the present modified example is constituted by a first hole 82*ax* formed in the center of the equilateral triangle, a second hole 82*ay* formed in the center of another equilateral triangle adjacent to this equilateral triangle, and a connecting hole 82*az* that connects the first hole 82*ax* and the second hole 82*ay*. In other words, the passage holes 82*a* of the present modified example widen from the center of the equilateral triangle to the center of another equilateral triangle adjacent to this equilateral triangle.

Next, a second modified example of the passage holes will be described with reference to FIG. 7.

The tubes are also arranged in an equilateral triangular shape in the present modified example, in a similar manner to the first embodiment and first modified example.

The passage holes 82 of the first embodiment and the passage holes 82*a* of the first modified example are all independent of the tube holes 81. Meanwhile, the passage holes 82*b* of the present modified example are connected to the tube holes 81. In the present modified example, three of the passage holes 82*b* are connected to one of the tube holes 81. As described above, the tube hole 81 is circular about a vertex of an equilateral triangle. One of the passage holes 82*b* widens from the tube-hole 81 from a vertex of the equilateral triangle toward a midpoint on a bottom side of the equilateral triangle. Similarly, the remaining passage holes 82*b* for the one tube-hole 81 also widen from the tube hole 81 from a vertex of the equilateral triangle toward the midpoint on the bottom side of the equilateral triangle. However, the three passage holes 82*b* are disposed with 120° intervals therebetween with reference to the vertices of the equilateral triangle.

Next, a third modified example of the passage holes will be described with reference to FIG. 8.

The tubes are arranged in a square shape in the present modified example differing from the first embodiment, first modified example, and second modified example. In other words, each of the inlet-side straight-tube sections 21*a* of the plurality of U-tubes 20 in the present modified example is disposed in a position at the vertex of a square. Moreover, each of the outlet-side straight-tube sections 21*b* of the plurality of U-tubes 20 is also is disposed at the vertex of a square. In other words, the plurality of tube holes 81 are all disposed in positions at the vertices of squares.

The passage holes 82*c* of the present modified example are formed in the center of the aforementioned square. The present modified example and the first embodiment differ in tube arrangement, but are similar in that the passage holes are formed in the center of a regular polygon formed by connecting the centers of the plurality of tube holes 81.

Even when the tubes are arranged in a square shape such as in the present modified example, the passage hole can be constituted by a first hole formed in the center of the square, a second hole formed in the center of another square adjacent to this square, and a connecting hole that connects the first hole and the second hole, in a similar manner to the second modified example. Furthermore, even when the tubes are arranged in a square shape such as in the present modified example, the passage holes may be connected to the tube holes 81, in a similar manner to the second modified example. When the tubes are arranged in a square shape, four passage holes are connected to one tube hole 81. The four passage holes are disposed with 90° intervals therebetween with reference to the vertices of the square.

For convenience, in FIGS. 3 and 6 to 8, the first passage holes 52*a* and the second passage holes 52*b* of the tube support plate 50, the third passage holes 62*a* of the first baffles 60*a*, and the fourth passage holes 62*b* of the second baffles 60*b* will simply be collectively denoted as passage holes, and the tube holes formed in the plates will also simply be collectively denoted as tube holes. Thus, the dimensions of the first passage holes 52*a* and the second passage holes 52*b* of the tube support plate 50 appear to be the same as the dimensions of the third passage holes 62*a* of the first baffles 60*a* and the fourth passage holes 62*b* of the second baffles 60*b*, but it is not necessary for these dimensions to be the same.

Furthermore, it is also not necessary for the shape and the like of the first passage holes 52*a* and the second passage holes 52*b* of the tube support plate 50 to match the shape and the like of the third passage holes 62*a* of the first baffles 60*a* and the fourth passage holes 62*b* of the second baffles 60*b*. For example, the shape and the like of the first passage holes 52*a* and the second passage holes 52*b* of the tube support plate 50 may be the shape and the like of the first embodiment, and the shape and the like of the third passage holes 62*a* of the first baffles 60*a* and the fourth passage holes 62*b* of the second baffles 60*b* may be the hole shape and the like of the first modified example, second modified example, or the like. Inversely, the shape and the like of the third passage holes 62*a* of the first baffles 60*a* and the fourth passage holes 62*b* of the second baffles 60*b* may be the shape and the like of the first embodiment, and the shape of the first passage holes 52*a* and the second passage holes 52*b* of the support plate 50 can be the hole shape and the like of the first modified example, second modified example, or the like.

INDUSTRIAL APPLICABILITY

One aspect of the present invention makes it possible to suppress vibration of U-tubes while increasing the heat transfer area between a tube-exterior fluid and a tube-interior fluid.

REFERENCE SIGNS LIST

10 Outer cylinder
11 Trunk part
12 First end plate
13 First end
14 Second end plate
15 Second end
16 Tube-interior side inlet nozzle
17 Tube-interior side outlet nozzle
18 Tube-exterior side inlet nozzle
19, 19*a* Tube-exterior side outlet nozzle
20, 20*a*, 20*b*, 20*c* U-tube
21 Straight-tube section
21*a* Inlet-side straight-tube section
21*b* Outlet-side straight-tube section
22*a* Inlet end
22*b* Outlet end
25 Straight-tube section
25*a* Smallest curved-tube section
25*b* Intermediate curved-tube section
25*c* Largest curved-tube section
26 Center of curvature
30 Tube plate
31 Tube hole
40 First partition wall
45 Second partition wall
46 Opening
50 Tube support plate
51*a* First tube hole
51*b* Second tube hole
52*a* First passage hole
52*b* Second passage hole
60*a* First baffle
60*b* Second baffle
61*a* First tube hole
61*b* Second tube hole
62*a* Third passage hole
62*b* Fourth passage hole
71 Inner guide
72 Convex curved surface
73 Middle guide
74 Concave curved surface
75 Convex curved surface
76 Outer guide
77 Concave curved surface
81 Tube hole
82, 82*a*, 82*b*, 82*c* Passage hole
85 Inner cylinder
86 Trunk part
87 End plate
88 Partition plate
90 Tube-interior fluid chamber
91 Inlet chamber
92 Outlet chamber
93 Tube-exterior fluid chamber
94 Straight-tube chamber
94*a* First straight-tube chamber
94*b* Second straight-tube chamber
95 Curved-tube chamber
96 Cylinder-interior outlet flow path
Fi Tube-interior fluid
Fo Tube-exterior fluid
X Axial line
Dx Axial direction
D1 First end side
D2 Second end side

The invention claimed is:

1. A U-tube heat exchanger, comprising:

an outer cylinder having a cylindrical shape and of which both ends are closed;

a tube plate that divides an inside of the outer cylinder at a position on a first end side of the both ends into a tube-interior fluid chamber on the first end side and a tube-exterior fluid chamber on a second end side;

a plurality of U-tubes disposed in the tube-exterior fluid chamber with both ends being fixed to the tube plate, the both ends of the plurality of U-tubes facing the tube-interior fluid chamber;

a first partition wall that divides the tube-interior fluid chamber into an inlet chamber facing an inlet end group which is a collection of inlet ends of the both ends of the plurality of U-tubes and an outlet chamber facing an outlet end group which is a collection of outlet ends of the both ends of the plurality of U-tubes;

a tube support plate that divides the tube-exterior fluid chamber into a curved-tube chamber including a curved-tube group which is a collection of curved-tube sections of the plurality of U-tubes on the second end side and a chamber on the first end side, the tube support plate supporting inlet-side straight-tube sections that extend from the inlet ends of the plurality of U-tubes and outlet-side straight-tube sections that extend from the outlet ends of the plurality of U-tubes; and a second partition wall that divides the chamber on the first end side relative to the curved-tube chamber of the tube-exterior fluid chamber into a first straight-tube chamber including an inlet-side straight-tube group which is a collection of the inlet-side straight-tube sections of the plurality of U-tubes and a second straight-tube chamber including an outlet-side straight-tube group which is a collection of the outlet-side straight-tube sections of the plurality of U-tubes, wherein, in the second end side of the second partition wall closer to the first end side than the tube support plate, an opening is formed that penetrates from the first straight-tube chamber toward the second straight-tube chamber, and the tube support plate includes at least one first passage hole formed penetrating from the first straight-tube chamber to the curved-tube chamber, and at least one second passage hole formed penetrating from the second straight-tube chamber to the curved-tube chamber.

2. The U-tube heat exchanger according to claim 1, wherein the at least one first passage hole comprises a plurality of first passage holes, wherein the at least one second passage hole comprises a plurality of second passage holes, and wherein an area of the opening is greater than a total flow path cross sectional area of the plurality of first passage holes and a total flow path cross sectional area of the plurality of second passage holes.

3. The U-tube heat exchanger according to claim 1, wherein the tube support plate includes first tube holes in which respective inlet-side straight-tube sections of the plurality of U-tubes are inserted, and second tube holes in which respective outlet-side straight-tube sections of the plurality of U-tubes are inserted, the first passage holes are formed in positions between the plurality of first tube holes of the tube support plate, and the second passage holes are formed in positions between the plurality of second tube holes of the tube support plate.

4. The U-tube heat exchanger according to claim 1, wherein the tube support plate includes first tube holes in which respective inlet-side straight-tube sections of the plurality of U-tubes are inserted, and second tube holes in which respective outlet-side straight-tube sections of the plurality of U-tubes are inserted, the first passage holes connect to any one of the plurality of first tube holes, and the second passage holes connect to any one of the plurality of second tube holes.

5. The U-tube heat exchanger according to claim 1, further comprising a guide disposed in the curved-tube chamber, separated from the plurality of U-tubes, and having a curved surface that curves along the curved-tube section of a U-tube of any one of the plurality of U-tubes.

6. The U-tube heat exchanger according to claim 5, wherein a radius of curvature of the curved-tube section of a U-tube of any one of the plurality of U-tubes differs from a radius of curvature of the curved-tube sections of other U-tubes, and the guide includes at least one guide among:

an inner guide that, relative to a smallest curved-tube section which is the curved-tube section with a smallest radius of curvature, is positioned on the radius of curvature side of the smallest curved-tube section, and has a convex curved surface that curves along the center of curvature side of the smallest curved-tube section;

an outer guide that, relative to a largest curved-tube section which is the curved-tube section with a largest radius of curvature, is positioned on an opposite side of the radius of curvature side of the largest curved-tube section, and has a concave curved surface that curves along the opposite side of the largest curved-tube section; and a medium guide positioned between the smallest curved-tube section and the largest curved-tube section, and has a concave curved surface that curves along an opposite side of the radius of curvature side of the smallest curved-tube section and a convex curved surface that curves along the radius of curvature side of the largest curved-tube section.

7. The U-tube heat exchanger according to claim 1, further comprising:

at least one first baffle disposed in the first straight-tube chamber and widening in a direction intersecting a direction in which the inlet-side straight-tube sections extend; and at least one second baffle disposed in the second straight-tube chamber and widening in a direction intersecting a direction in which the outlet-side straight-tube sections extend, wherein the at least one first baffle includes at least one third passage hole penetrating in the direction in which the inlet-side straight-tube sections extend, and the at least one second baffle includes at least one fourth passage hole penetrating in the direction in which the inlet-side straight-tube sections extend.

* * * * *